United States Patent [19]

Brown

[11] 4,109,413

[45] Aug. 29, 1978

[54] LEVITATION TOY AND METHOD OF OPERATION THEREOF

[76] Inventor: Paul L. Brown, 982 Lakeview Way, Redwood City, Calif. 94062

[21] Appl. No.: 767,205

[22] Filed: Feb. 9, 1977

[51] Int. Cl.[2] ..... A63H 33/26

[52] U.S. Cl. ..... 46/233; 46/74 R

[58] Field of Search ..... 46/233, 234, 235, 236, 46/238, 239, 76 R, 1 H, 74 R; 35/19 A

[56] References Cited

U.S. PATENT DOCUMENTS

| | | | |
|---|---|---|---|
| 2,018,585 | 10/1935 | Weil | 46/233 |
| 3,196,566 | 7/1965 | Littefield | 46/236 |
| 3,497,994 | 3/1970 | Lee | 46/233 |

FOREIGN PATENT DOCUMENTS

| | | | |
|---|---|---|---|
| 854,384 | 1940 | France | 46/233 |

*Primary Examiner*—Louis G. Mancene
*Assistant Examiner*—Mickey Yu

[57] ABSTRACT

Electrostatically charged components of the same polarity comprising a charged tube or wand for launching into and maintaining levitation or flight of any selected one or more of a plurality of similarly charged levitatable objects of similar and dissimilar shapes and dimensions, and a method of producing and utilizing the same.

9 Claims, 12 Drawing Figures

Fig. 1
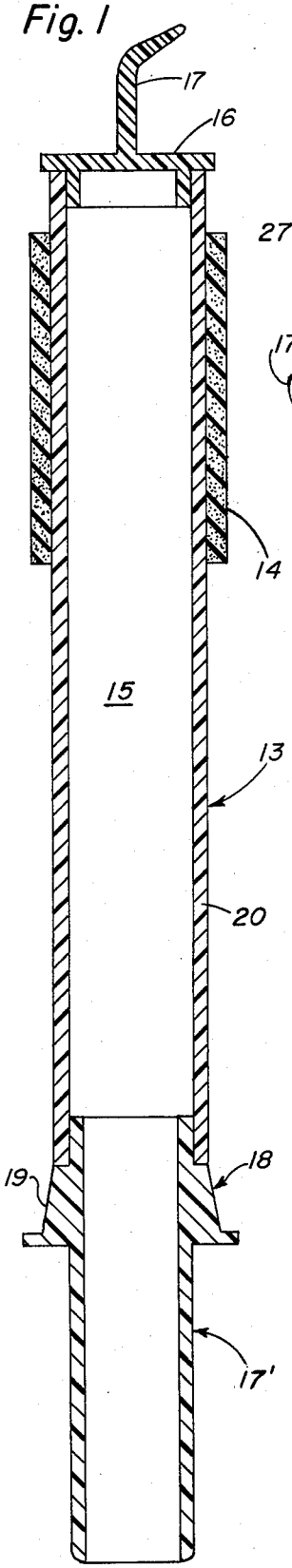
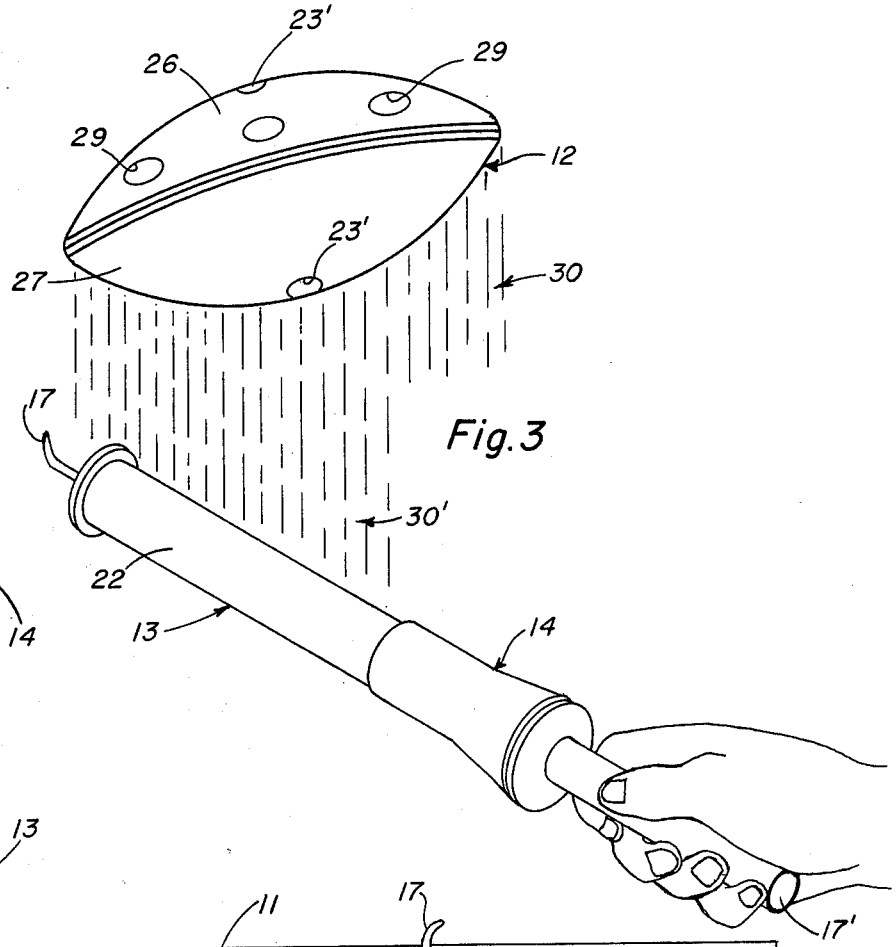
Fig. 3
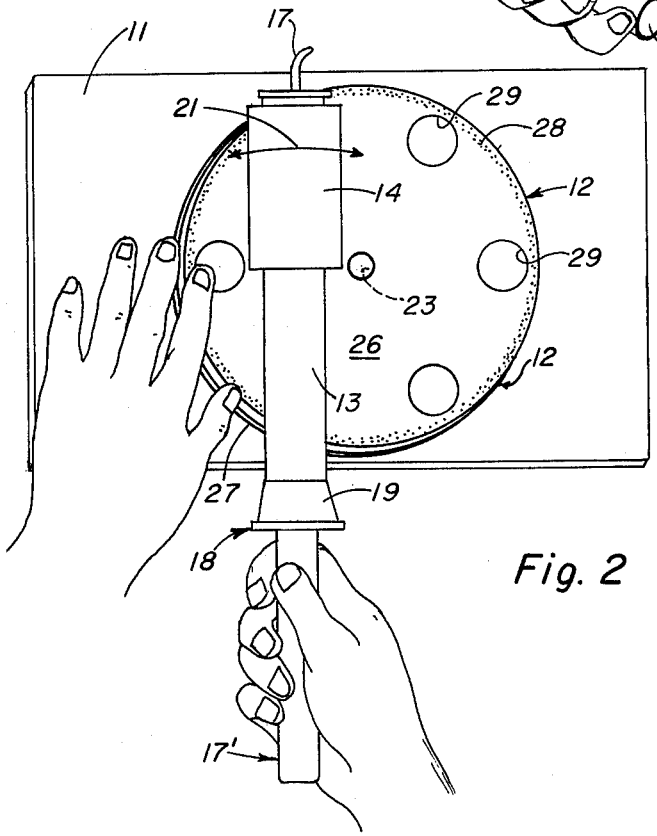
Fig. 2

LEVITATION TOY AND METHOD OF OPERATION THEREOF

The present invention relates generally to toys or toy systems. More particularly the invention relates to electrostatically charged levitatable objects that are controllably levitated in a field of electrostatic lines of force utilizing a similarly charged tube or wand for launching into space a selected one or more of such charged objects which can be moved in infinite directions by selected manipulations of the hand held charged tube.

As early as the year 1663, frictional machines were constructed and used down through the centuries but have been largely replaced with influence machines operating by electrostatic induction to convert mechanical work into electrostatic energy. This invention is in this field of endeavor. A number of United States Letters Patent have been granted on these so-called influence machines as well as at least one French patent with which I am familiar, namely, No. 324,108, issued Mar. 24, 1903 to Mr. Henri Chasles and covering the levitation of a collodian object or floating body "*a*" in the general shape of a cone and electrically charged negatively, utilizing a negatively charged stick "*b*" to launch the body by repelling forces into the air. The body "*a*" can be shaped in the form of balloon and filled with air or gas, and the stick "*b*" can be made of glass. United States Patent, No. 2,018,585, was issued to Weil in Oct. 1935 and discloses the combination of an electrically non-conductive rod having a metal covering at one end thereof and carrying an exciter on its handle, together with a thin member capable of receiving an electrical charge and be repelled into the air by the metal charged end of the rod after excitation thereof. Another U.S. patent, No. 3,497,994 was issued to Bert Lee on Mar. 3, 1970 and discloses a pair of relatively movable rods for levitating an electrostatically charged member, a colored feather, and for directing the flight thereof in space. I also am familiar with a recently marketed toy, termed "Mystoplane", manufactured by the Mastercraft Toy Co. Inc. of 19 West 24th Street, New York, N.Y; such toy pertaining to a system of utilizing a charged wand having a metal tip upon which any one of a number of planes are caused to alight and promptly be repelled and maintained in flight by the charged wand. Most of these prior toys and toy systems are disadvantageous because of the cost of metal tips or glass charging rods and of the fragile nature of the charged objects which are damaged quickly and are difficult to replace with the result that the toys are discarded long before desired. My present invention obviates all of the disadvantages of prior toys in this environment and provides electrostatically charged objects of much larger area and more realistic in shape than has been previously accomplished to afford mobile and fluidic as well as undulating units which are readily controlled in airborne variable directions for much longer periods of time.

A primary object of my present invention is to provide improved multi-component equipment for levitating an infinite variety of shaped levitatable objects which afford directional movements governed by an operator's selective manipulation of a hand-held control device.

Another object of the invention is to provide levitation equipment of the indicated nature which is additionally characterized by the inclusion in the system of a plurality of dimensionally convertible objects rendered upon and during levitation thereof.

A further object of my invention is to provide a combination of levitational elements of the indicated nature capable of being utilized by small children with equal facility as adults to afford enjoyable flight patterns of a wide variety of levitatable objects.

Another important object of my present invention is to provide an improved method of construction of all the components of a levitational toy system, each embodying physical attributes to effect conversion of shaped objects from unidimensional form to three-dimensional form upon and during levitation thereof.

Other objects of the invention, together with some of the advantageous features thereof, will appear from the following description of embodiments thereof illustrated in the accompanying drawings and which are exemplifications of the best mode of construction thereof and manner of using the same. The appended claims are intended to cover not only the embodiments but also to cover variations thereof within the scope and purview of the invention.

REFERRING TO THE DRAWINGS

FIG. 1 is a sectional elevational enlarged view of a combined wand and exciter component constituting parts of a preferred embodiment of the multi-component equipment of the present invention.

FIG. 2 is a reduced top plan view of three principal components of my preferred embodiment of the invention; this view showing the combined wand and exciter of FIG. 1 in reduced form and in operative position engaging a charging pad component.

FIG. 3 is an exploded front perspective view of an electrostatically charged object in levitation under the control of an electrostatically charged wand in the hand of an operator; this view indicating in dash lines the movement of electrostatic lines of force moving upwardly from the wand and downwardly from the object which maintain the object airborne in three-dimensional form.

Figure 4:
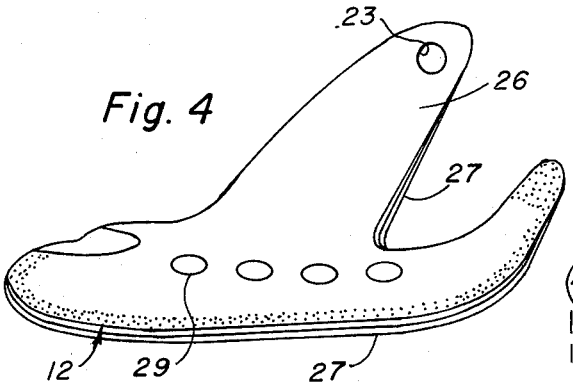
FIG. 4 is a front elevational view of a two-dimension levitatable object which is utilizable as one component of the multi-component equipment of the preferred embodiment of my present invention.

In accordance with my present invention I provide as principal components of my improved levitatable toy system for levitating a variety of objects, a flat pad 11 on which any selected one of a plurality of objects generally designated by the reference numeral 12, may be removably seated as well as an electrostatically chargeable wand 13 for effecting the launching of an electrostatically charged object from the pad 11 into space and for maintaining it in space, together with an exciter 14 for inducing an electrostatic charge of a definite polarity on a portion of said wand 13 and simultaneously inducing an electrostatic charge of the same polarity on the selected object 12; such exciter 14 being rotatably mounted in both directions of rotation on the wand 13, as indicated by the double arrow 21 in FIG. 2 of the annexed drawings, as well as slidably mounted on the wand as indicated in FIGS. 1 and 3 showing the exciter 14 located at opposite ends of the wand. All of the foregoing principal components 11, 12, 13 and 14 are fabricated or molded from a plastic material, such as polyurethane, polyethylene or acetate for the pad 11; thin closed-cell polypropylene for the objects 12; polyethylene or polypropylene for the wand 13; and polyurethane for the exciter 14; it being noted that these thermoplastic materials are used throughout the levitation toy system because it has been found that said materials are less influenced by the electrostatic deterrent nature of humid weather than other combinations of non-thermoplastics and metals.

With reference to FIG. 1, it will be observed that the control wand is molded in tubular form defining an elongated chamber 15 and is provided with a closure 16 at one end thereof having an integral projecting hook 17 and with a closure handle 17′ on its opposite end provided with a tapering flange 18 affording a seat 19 for the exciter 14 when brought to rest at the handle end of the wand. As is clear from FIGS. 1 and 3 of the annexed drawings, the endless exciter 14 encircles the periphery of the wand enabling sliding movement of the exciter 14 as well as rotation thereof, as indicated by double arrow 21, in relation to an underlying object 12 disposed on pad 11. FIGS. 1 and 2 both show the exciter 14 in charging position on the wand 13 and during the charging of a selected object 12 and a portion 22 of the wand 13 which underlies the exciter simultaneously by the rolling or rotation of the exciter thereon. When not in use as a charging means, the exciter 14 is moved to the opposite end of the wand to ride up and become seated on the tapered section 19 of the tapered flange 18 where it remains until it is used again for electrostatically charging the same or another selected object 12. It is to be further observed that each of the objects 12 is formed with an opening 23 therethrough, through which the hook 17 of wand 13 is extended to lift the charged object 12 from the charging pad and to launch the same into space. In launching any charged object 12, the unidimensional or two dimensional object, as the case may be, immediately is converted to three dimensional form and remains in such form while in levitation.

The levitatable objects which I have provided are formed to a variety of shapes and are normally either unidimensional or two dimensional in their uncharged state, as illustrated in FIGS. 2, 4, 6, 8 and 10 of the annexed drawings, and are either of single ply polypropylene or two ply polypropylene. A double ply inflatable object 12 is illustrated in FIG. 2 and has a circular top surface 26 with a circular bottom surface 27, such object being cemented or otherwise adhesively secured together adjacent to the circumference thereof as indicated by the dots 28, and being formed with circumferentially aligned spaced apart holes 29 extending through both the top 26 and bottom 27 thereof. Upon levitation, the selected object of FIG. 2, immediately converts in a free-flowing action to the three-dimensional form of FIG. 3 simulating a so-called UFO (unidentified flying object) with the openings 29 simulating windows or ports therein. The separation of the top and bottom surfaces 26 and 27 upon launching affords top and bottom central openings 23′ which in the flat form of FIG. 2 is a through opening 23.

Figure 5:
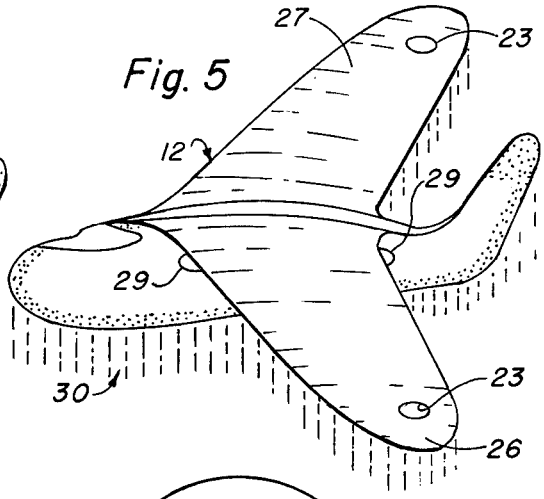
FIG. 5 is a perspective view of the component of FIG. 4 but in three-dimensional form after being electrostatically charged; this view indicating in dash lines the charging lines of force moving downwardly from the airborne dimensionally converted object.

In FIGS. 4 and 5, I have illustrated a two dimensional levitatable object in the form of a simulated aircraft which is converted, after electrostatically charging it and launching it into space with the aid of electrostatically charged wand 13, into three dimensional form simulating a full-bodied flying aircraft. The dash lines 30 in FIG. 5 indicate lines of electrostatic force emanating downwardly from the charged flying aircraft 12 which are met and repelled by lines of electrostatic lines of force of the same polarity emanating from the charged wand 13, not shown in the view of FIG. 5. Such lines of force are absent from FIG. 4 because the object 12 is not charged as depicted in this view. It is to be understood that movement of this aircraft object 12 of FIG. 5 is under the control of the person in whose hand the electrostatically charged wand 13 is held and manipulated in relation to the charged aircraft, guiding it about in space in full flight.

Figure 7:
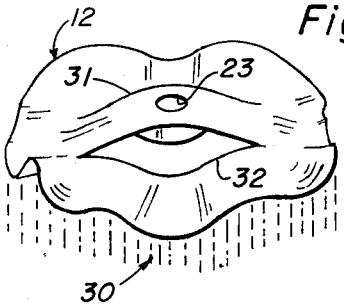
FIG. 7 is a front perspective view of the levitatable object of FIG. 6 but in converted three-dimensional form after being electrostatically charged; this view indicating in dash lines the lines of electrostatic force moving downwardly from the charged airborne object.

In accordance with the invention, other specially constructed objects can be made components of the system and of the embodiments illustrated. For example, and in order to effect simulated animated gargoyles or ghosts floating in air, see FIG. 7, I provide a single ply or unidimensional disc object 12 of circular contour having a central opening 23 through which the hook 17 of the wand 13 is insertable for picking up the object after electrostatically charging the same and for launching the same into space, and having straight slits 31 and 32 therein arranged on opposite sides of the hole 23 and in parallel relationship, see FIG. 6. Upon launching the object 12 of FIG. 6 into space, the charged object immediately is converted to three-dimensional form, as shown in FIG. 7. The dash lines 30 extending downwardly from the object 12 shown in FIG. 7 indicate electrostatice lines of force emanating from this charged object which meet and are repelled by lines of force of the same polarity moving upwardly from the handheld electrostatically charged control wand 13, not shown here.

Figure 6:
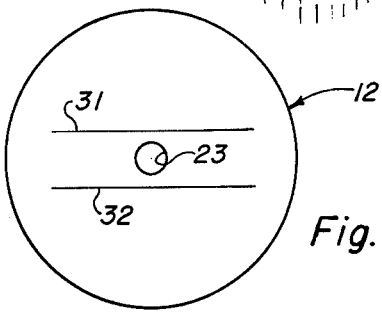
FIG. 6 is a top plan of a single ply or uni-dimensional levitatable object especially constructed for utilization with other components of my multi-component equipment.
Figure 8:
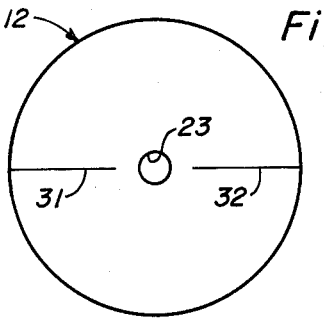
FIG. 8 is a top plan view of a modification of a single ply or unidimensional specially constructed levitatable object.

In FIG. 8 I have shown an uncharged object 12 of circular contour which is constructed from single ply or unidimensional thin closed cell polypropylene and provided with slits 31 and 32 extending on opposite sides of hole 23 in linear alignment rather than in parallel to one another as in the case of the single ply object 12 shown in FIG. 6. When the object 12 of FIG. 8 is electrostatically charged in the same manner as illustrated in FIG.

Figure 9:
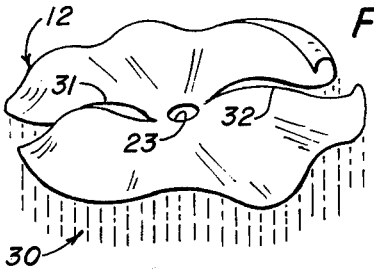
FIG. 9 is a front perspective view of the levitatable object of FIG. 8 but in converted three-dimensional form after being electrostatically charged and airborne; this view indicating in dash lines the lines of electrostatic force moving downwardly from the levitated object.

2 by rolling the exciter 14 to and fro while in engagement therewith while disposed on pad 11 and launched by insertion of the hook 17 of wand 13 into the hole 23 of the object and then raising the wand to a near vertical position, the object 12 instantly is wafted free of the hook 17 and assumes the three-dimensional form shown in FIG. 9 resembling or simulating a relatively large leaf. The levitated object of FIG. 9 is maintained in levitation by virtue of the repelling lines of force 30 emanating downwardly from the levitated object of the same polarity as the lines of force emanating upwardly from the charged wand 13, not shown in this view.

Figure 10:
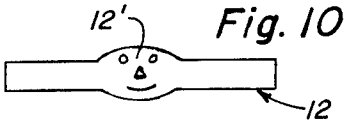
FIG. 10 is a front elevational view of the levitatable object of FIG. 11 but uncharged and in two dimensional form.
Figure 12:
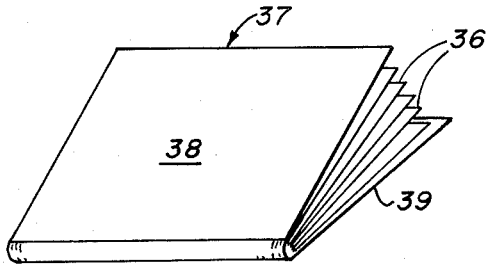
FIG. 12 is a perspective view of a dry storage multi-leaf receptacle for holding a plurality of levitatable objects when not in use.
Figure 11:
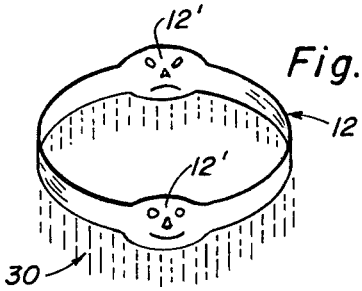
FIG. 11 is a front perspective view of the levitatable object illustrated in FIG. 10 but in three-dimensional form in levitation.

A different type of object 12 is illustrated in FIGS. 10 and 11 wherein the three-dimensional charged object 12 is in the form of a ring having diametrically opposed animated caricatures 12' delineated thereon. In FIG. 10, the ring is flattened to a double ply strip during a charging period but is distended to a three-dimensional state after having been charged, and launched into levitation where it remains during levitation under the repelling lines of force 30 emanating downwardly from the levitated ring, see FIG. 11 and the upwardly emanating lines of force from the charged wand 13, not shown in this view.

To utilize and enjoy the toy system hereinabove described and hereafter claimed, the pad 11 is placed upon a level surface such as a flat table or a level floor, not shown; and any one of the plurality of levitatable objects 12 is removed from between the pages 36 of a booklet 37 which are conveniently bound between the covers 37 and 39 thereof, and placed flat upon the plastic charging pad 11. The player or operator of the toy system then moves the polyurethane sleeve or exciter 14 from its seated position on the tapered outer surface 19 of the handle flange 18 of wand 13 and slides the same the full length of the wand so as to rest against the flange of closure 16. Thereafter the wand is lowered to bring the exciter 14 into engagement with the upper surface of the object 12 resting on the charging pad 11, and the player rolls the exciter 14 briskly a number of times over the plastic film object 12 thus electrostatically charging the same. The player then lifts the wand 13 from charging pad 11 and slides the exciter toward the handle 17' and seats it out of the way upon the tapered surface 19 again. By rolling action of the exciter 14 upon the object 12 while on pad 11, the operator not only induces a positive electrostatic charge upon the surface of the plastic film object 12 but also induces a similar charge upon that portion 22 of the periphery of wand 13 underlying the exciter 14 during the rolling of the exciter. The operator then inserts the extended pick-up and launching tip 17 of the wand into the hole 23, see FIG. 2 and FIGS. 4, 6, 8 and 9 of the object 12 and lifts the object off the charging pad.

Once the control wand 13 reaches a vertical or near vertical position upon the launching action, the repelling electrostatic forces, indicated at 30 and 30' in FIGS. 3, 5, 7, 9 and 11 except with omissions of 30' in the last four views, between the positively charged objects 12 as well as the positively charged wand 13 in the hand will cause the object quickly to release itself from the pick-up hook 17 and the object will remain in a state of fluid levitation above the control tube, buoyed there by the repelling nature of the electrostatic lines of force 30 and 30' that have been generated by the similarly induced positive charges upon the object 12 and tube 13 by the brisk rolling action of the exciter 14 over the object and the rollable engagement thereof with the tube 13. It is clear that the contol tube 13 can be made to a sufficient length as to permit easy control of the object 12 and to prevent any of such flying or airborne objects 12 from being attracted to the operator's body or to any contiguous or adjacent negatively charged mass and thus cause the object 12 to fall or to adhere to the mass. To retrieve the airborne or levitated object ay any time, the operator merely extends his free hand to the vicinity of the object whereby the object will be attracted to his negatively charged hand.

It is to be observed that in levitating single ply objects 12, such as the disc shown which contains straight parallel slits 31 and 32 therein, the object will quickly, upon being launched, become three-dimensional as shown in FIG. 7 with the straight slits 31 and 32 becoming curved slits and the circumference of the disc also becoming materially distorted or distended by and during levitation. Moreover if an operator elects to remove a two-ply object 12 from the booklet 38 and levitate the same by following the steps hereinabove outlined, the two-ply object is instantly converted into a three-dimensional object, see FIGS. 2 and 3 simulating an unidentified flying object; it being noted that during the positive charging of the outer surfaces 26 and 27 of the object illustrated in FIG. 2 the inner confronting faces of this two-ply object become negatively charged so as to repel one another and thus, during the launching step of these two-ply objects 12 such repelling forces of the inner negatively charged faces conduce to the instant formation of a three-dimensional configuration that is floatingly and undulatingly buoyed upon a field of electrostatic lines of force.

It is to be understood that the appended claims are intended to cover not only the embodiments illustrated in the accompanying drawings but also variations thereof within the scope and purview of the present invention.

I claim:

1. Equipment for levitating dimensionally convertible shaped levitatable objects; said equipment comprising in combination, a shaped levitatable object of a predetermined dimension and having an opening therethrough, a flat pad for removably holding said object during an electrostatically charging period, and an electrostatically chargeable wand, a flanged handle on one end of said wand, the flange of which has a tapered periphery, an exciter removably seatable upon said tapered periphery of the flange of said handle and slidably as well as rotatably mounted on said wand for inducing an electrostatic charge on said wand while simultaneously inducing an electrostatic charge of the same polarity on said object held on said pad by rolling engagement therewith, and means for lifting said object from said pad after it has received an electrostatic charge and launching the same into space; said means comprising a flexible hook on said wand insertable into said opening and engaging a portion of a charged object adjacent to said opening to lift the charged object from said pad into the air where it is repelled from said wand by the upwardly moving electrostatic lines of force emanating from said electrostatically charged wand and the downwardly moving lines of force emanating from said object and thereby sustained in levitation.

2. Equipment as set forth in claim 1 wherein said shaped object is unidimensional.

3. Equipment as set forth in claim 1 wherein said shaped object is three-dimensional.

4. Equipment as set forth in claim 2 and a pair of slits in substantially parallel arrangement in said unidimensional object.

5. Equipment as set forth in claim 2, and at least one slit in said unidimensional object.

6. Equipment as set forth in claim 2 and a pair of slits in said unidimensional object arranged in linear extension on opposite sides of said opening.

7. Equipment as set forth in claim 3 wherein said three-dimensional object comprises a pair of back-to-back elements connected together at the perimeters thereof.

8. Equipemnt as set forth in claim 1 wherein said exciter encompasses said wand for a shorter distance than the length thereof.

9. A method of levitating shaped unidimensional objects; said method comprising the steps of simultaneously inducing electrostatic charges of the same polarity into an electrostatically chargeable control wand and an electrostatically chargeable unidimensional object by repetitively moving about the exterior surface of a portion of the wand and the entire exterior surface of the object a rotatable sleeve having the property of inducing electrostatic charges, and then launching the charged object into space thereby converting a unidimensional electrostatically charged object into a three dimensional charged object and maintaining the same in levitation by the action and counter-action of electrostatic lines of force emanating from said wand and said object.

* * * * *